US010486778B2

(12) United States Patent
Belesimo et al.

(10) Patent No.: US 10,486,778 B2
(45) Date of Patent: Nov. 26, 2019

(54) SLUICEWAY FOR BARGE

(71) Applicant: CASHMAN DREDGING AND MARINE CONTRACTING, CO., LLC, Quincy, MA (US)

(72) Inventors: Frank Belesimo, Easton, MA (US); Jay Cashman, Quincy, MA (US)

(73) Assignee: Cashman Dredging and Marine Contracting, Co., LLC, Quincy, MA (US)

( * ) Notice: Subject to any disclaimer, the term of this patent is extended or adjusted under 35 U.S.C. 154(b) by 0 days.

(21) Appl. No.: 16/360,603

(22) Filed: Mar. 21, 2019

(65) Prior Publication Data

US 2019/0291828 A1 Sep. 26, 2019

Related U.S. Application Data

(60) Provisional application No. 62/660,624, filed on Apr. 20, 2018, provisional application No. 62/646,082, filed on Mar. 21, 2018.

(51) Int. Cl.
*B63B 35/30* (2006.01)

(52) U.S. Cl.
CPC ..... *B63B 35/306* (2013.01); *B63B 35/305* (2013.01)

(58) Field of Classification Search
CPC .... B63B 35/306; B63B 35/305; B63B 35/303
See application file for complete search history.

(56) References Cited

U.S. PATENT DOCUMENTS

| | | | | | |
|---|---|---|---|---|---|
| 1,582,433 | A | | 4/1926 | Roach | |
| 1,609,179 | A | * | 11/1926 | Marotte | B63B 35/306 114/36 |
| 3,404,484 | A | * | 10/1968 | Klee | B63B 35/306 114/36 |
| 3,578,222 | A | | 5/1971 | Pot | |
| 4,030,435 | A | * | 6/1977 | Sensibar | B63B 35/306 114/36 |
| 4,176,885 | A | * | 12/1979 | Alkema | B63B 35/306 114/27 |
| 4,253,782 | A | * | 3/1981 | Brakel | B63B 35/303 406/118 |
| 4,548,147 | A | * | 10/1985 | Roggeveen | B63B 35/306 114/36 |
| 6,390,006 | B1 | | 5/2002 | Sridhar | |
| 9,365,370 | B2 | | 6/2016 | Walker | |
| 2008/0256870 | A1 | | 10/2008 | Nixon | |

* cited by examiner

*Primary Examiner* — Stephen P Avila
(74) *Attorney, Agent, or Firm* — Jacob M. Ward; Ward Law Office LLC

(57) ABSTRACT

A sluiceway device for a hopper barge has an elongate main body defining a discharge channel. The elongate main body has a plurality of openings. The elongate main body may be configured to be disposed atop a hull of the hopper barge and configured to receive dredging material placed in the hopper barge. The sluiceway device may also have a discharge pump. The discharge pump may be in communication with the discharge channel. The discharge pump may be further configured to pump the dredging material from the discharge channel to a disposal area outside of the hopper barge.

19 Claims, 8 Drawing Sheets

SLUICEWAY FOR BARGE

CROSS-REFERENCE TO RELATED APPLICATIONS

This application claims the benefit of U.S. Provisional Application Ser. No. 62/660,624, filed on Apr. 20, 2018, and U.S. Provisional Application Ser. No. 62/646,082, filed on Mar. 21, 2018. The entire disclosures of the above applications are hereby incorporated herein by reference.

FIELD

The present disclosure relates to hopper barges and, more particularly, to a device for retrofitting a hopper barge with a pumping system.

BACKGROUND

Dredging is defined as the underwater removal of soil, such as sand, gravel, and rocks, and its transport from one place to another. A hopper barge is a marine vessel that is employed in dredging operations, and is primarily used to carry materials like rocks, gravel, sand, and rubbish, from one location to another for dumping.

An important use of such barges is in the bulk transfer of materials used for land reclamation projects. Such projects require the transport of large volumes of aggregates, i.e., sand, silt, and the like, that are dredged at one location, loaded onto the barges, and discharged at a site where land is being reclaimed.

One known type of hopper barge is known as the "split barge." The split barge has a hull that selectively divides longitudinally between the end bulkheads. The vessel consists of two major parts, i.e., port and starboard halves. These halves are mostly symmetrical in design and are also hinged at the deck and operated by hydraulic cylinders. When the halves are closed, the hopper barge may be filled with materials for bulk transfer to another location. When the hopper barge is split opened, the contents of the hopper barge are dumped rapidly at the location of the hopper barge.

On many occasions, there is a need to dump the contents of the hopper barge onto a beach or disposal area on land, as opposed to dumping the contents of the hopper barge through the split opening of the hull. However, most hopper barges are not equipped to empty in this way. Retrofitting split-type hopper barges by installing pumping systems has heretofore been complicated, requiring significant changes to the structure of the barge. Such retrofitting operations are also time-consuming and expensive.

Further, even hopper barges that are already equipped with pumping systems are inefficient. It is difficult to empty the contents of these known barges even with pumps.

There is a continuing need for a sluiceway device and method of utilizing a hopper barge for pumping contents to a disposal area such as a beach. Desirably, the sluiceway device allows the hopper barge to be fully emptied in a more efficient manner than existing systems.

SUMMARY

In concordance with the instant disclosure, a sluiceway device and method of utilizing a hopper barge for pumping contents to a disposal area such as a beach, and which allows the hopper barge to be fully emptied in a more efficient manner than existing systems, is surprisingly discovered.

In one embodiment, a sluiceway device for a hopper barge includes an elongate main body defining a discharge channel. The elongate main body is configured to be disposed atop an inner surface of a hull of the hopper barge. The elongate main body is further configured to receive dredging material placed in the hopper barge. The elongate main body has a plurality of openings formed therein. There is a plurality of doors disposed adjacent the openings and configured to selectively seal and unseal the openings. Further, a discharge pump is in communication with the discharge channel. The discharge pump is configured to pump the dredging material from the discharge channel to a disposal area outside of the hopper barge.

In another embodiment, a sluiceway device for a hopper barge includes an elongate main body defining a discharge channel. The elongate main body is disposed atop an inner surface of a hull of the hopper barge. The elongate main body is further configured to receive dredging material placed in the hopper barge. The elongate main body has a plurality of openings formed therein. There is a plurality of doors disposed adjacent the openings and configured to selectively seal and unseal the openings. Further, a discharge pump is in communication with the discharge channel. The discharge pump is configured to pump the dredging material from the discharge channel to a disposal area outside of the hopper barge.

In a further embodiment, a method for operating the sluiceway device including providing a hopper barge and a sluiceway device with at least one opening. The sluiceway device has an elongate main body defining a discharge channel. The elongate main body is configured to be disposed atop an inner surface of a hull of the hopper barge. The elongate main body is configured to receive dredging material placed in the hopper barge. The main body has a plurality of openings formed therein. There is a plurality of doors disposed adjacent the openings and configured to selectively seal and unseal the openings. There is a discharge pump in communication with the discharge channel. The discharge pump is configured to pump the dredging material from the discharge channel to a disposal area outside of and spaced apart from the hopper barge. The method further includes filling the hopper barge with dredging material, opening the at least one opening to permit the dredging material to fall into the discharge channel, and pumping water into the discharge channel. The dredging material and water from the discharge channel are pumped from the hopper barge.

DRAWINGS

The drawings described herein are for illustration purposes only and are not intended to limit the scope of the present disclosure in any way. The above, as well as other advantages of the present disclosure, will become readily apparent to those skilled in the art from the following detailed description, particularly when considered in the light of the drawings described hereafter.

DETAILED DESCRIPTION

The following description is merely exemplary in nature and is not intended to limit the present disclosure, application, or uses. In respect of the methods disclosed, the order of the steps presented is exemplary in nature, and thus, is not necessary or critical unless otherwise disclosed.

In FIGS. 1-14, a sluiceway device 100 for a barge and a method 200 for using the sluiceway device 100 for the barge, according to various embodiments of the present disclosure, are shown.

Figure 1:
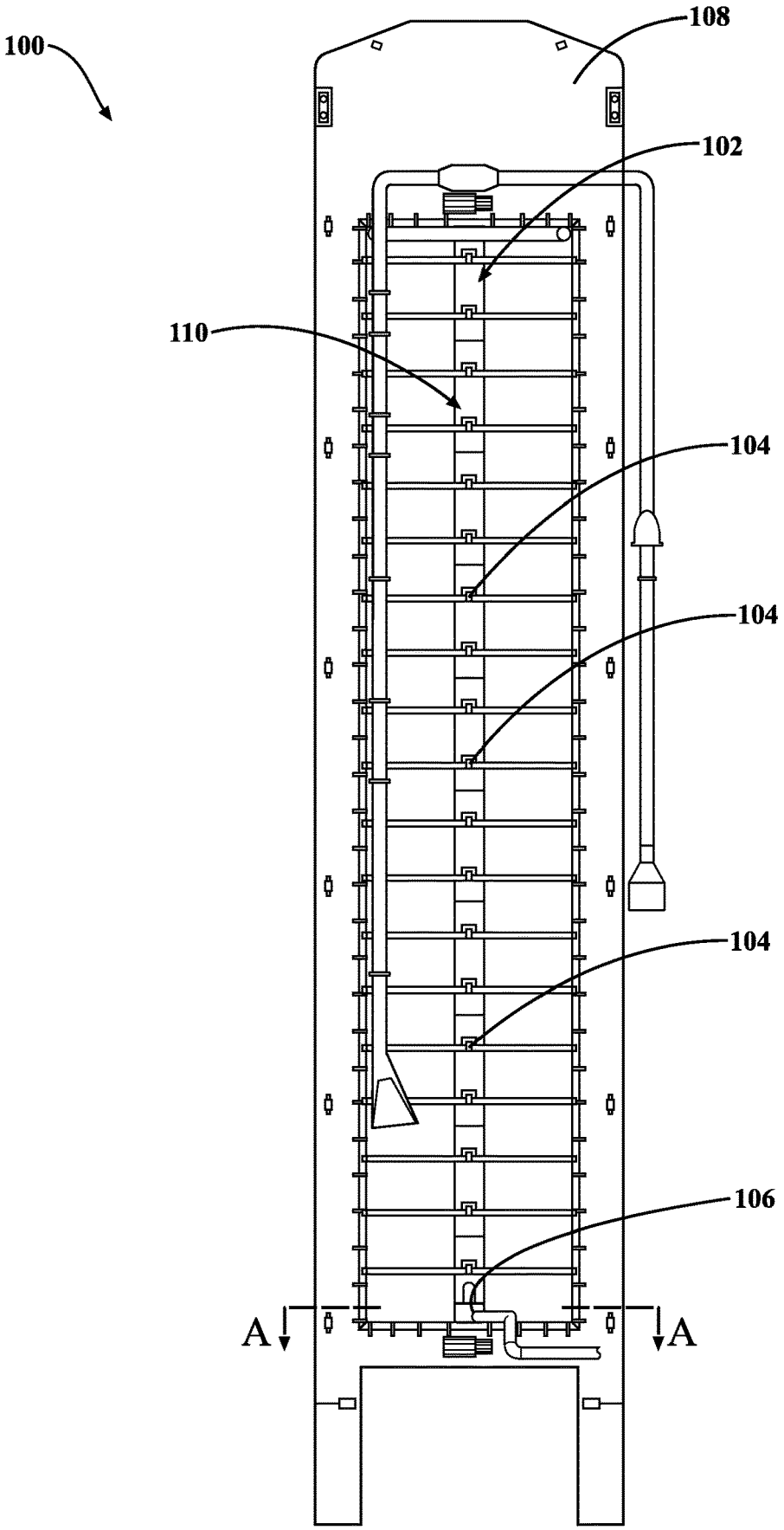
FIG. 1 is a top plan view of a hopper barge having a sluiceway device installed therein, according to various embodiments of the disclosure.

The sluiceway device 100 may include an elongate main body 102 having a plurality of openings 104, and a discharge pump 106. As shown in FIG. 1, the sluiceway device 100 according to the present disclosure may be configured to be inserted or installed on an inner surface of a split hull of a hopper barge 108. The hopper barge 108 may also have one or more additional pumps and conduits (not shown) in communication with the sluiceway device 100, and which are configured to pump water to facilitate a movement of dredging material 109 (shown in FIGS. 10-12) through the sluiceway device 100 to the end of the barge 108 with the discharge pump 106.

Figure 6:
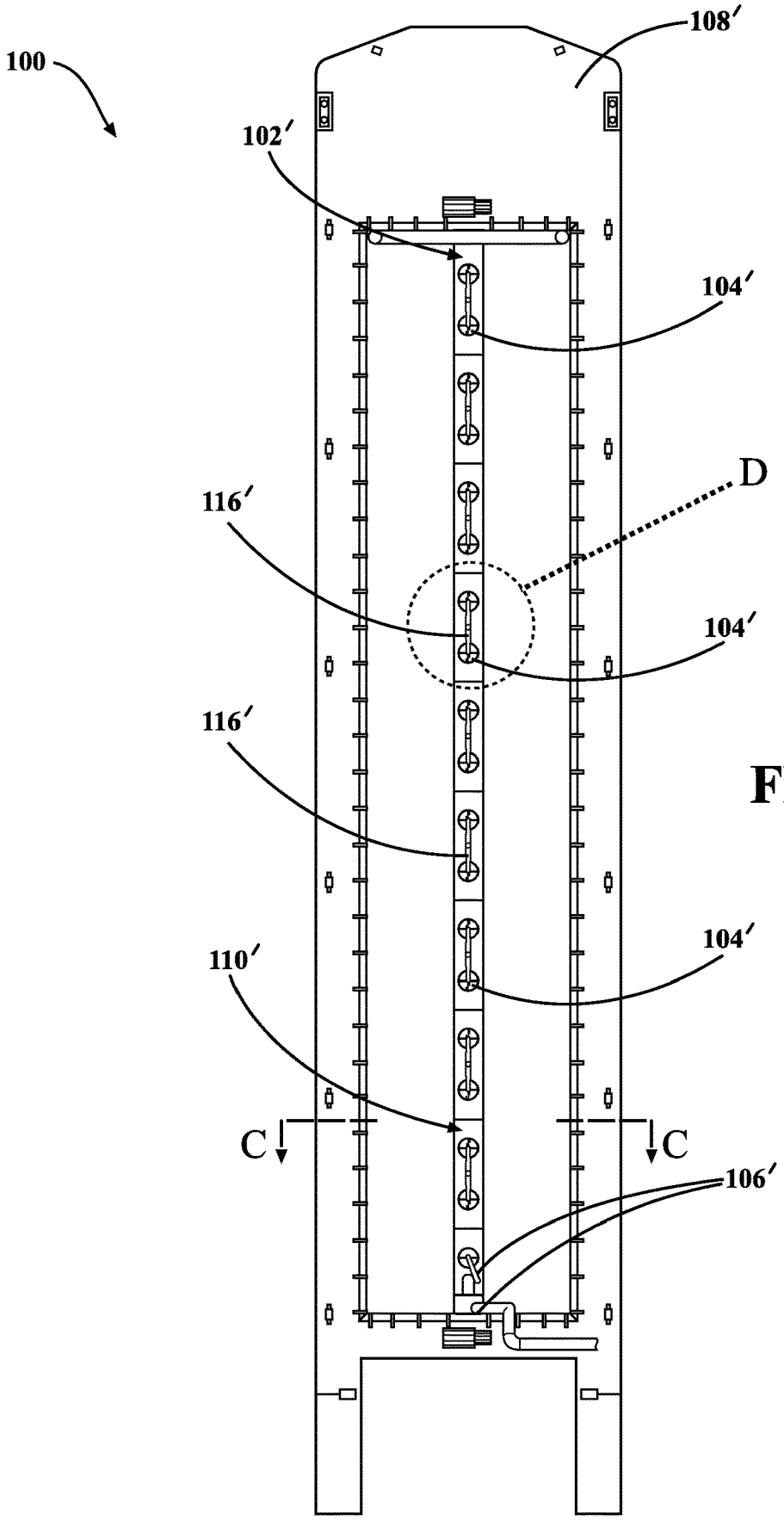
FIG. 6 is a top plan view of a hopper barge having a sluiceway device installed therein, according to yet another embodiment of the disclosure.
Figure 8:
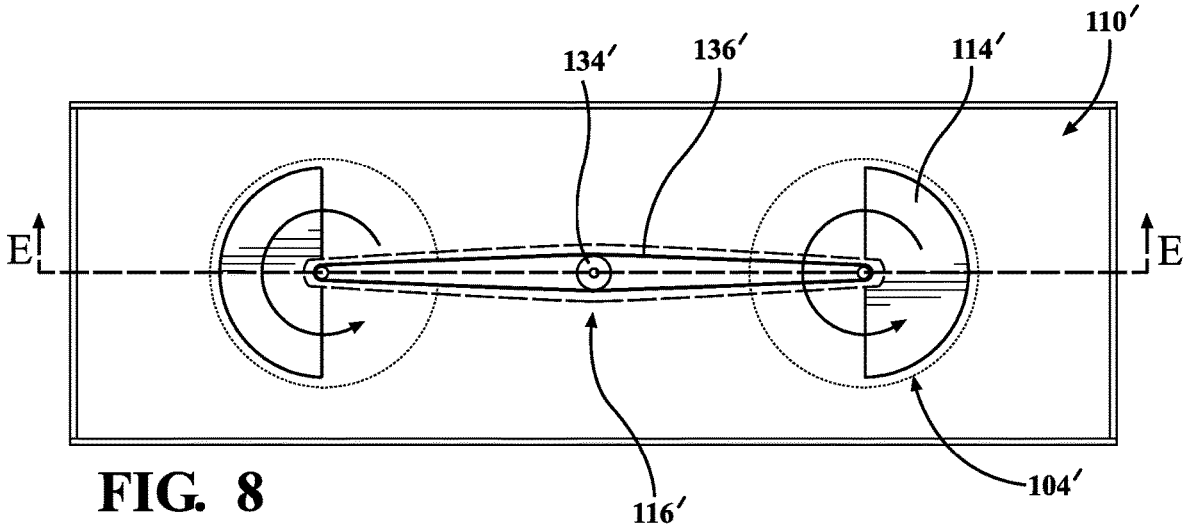
FIG. 8 is an enlarged top plan view of a hatch opening device of the sluiceway device taken at call-out D in FIG. 6.
Figure 9:
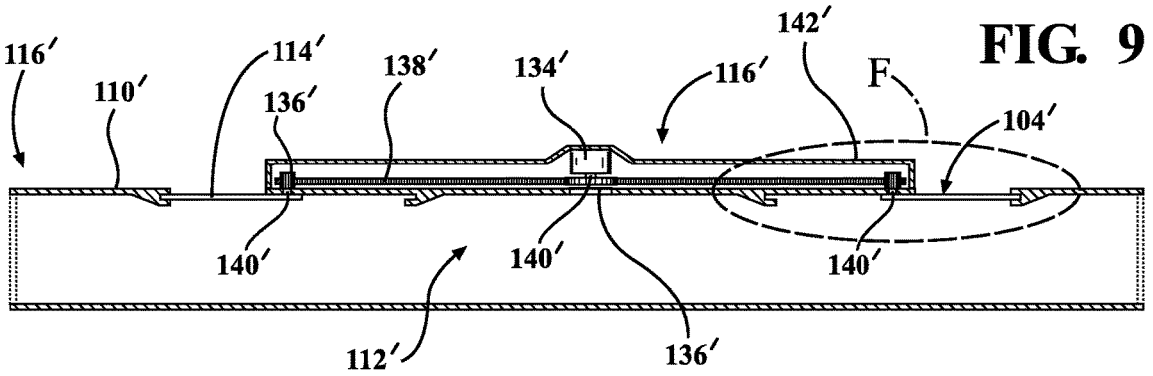
FIG. 9 is a cross-sectional, side elevational view of the hatch opening device of the sluiceway device taken along section line E-E in FIG. 8.

The sluiceway device 100 may have an elongate main body 102, for example, as shown in FIGS. 1 and 6. The elongate main body 102 may be oriented along a length of the hopper barge 108 and disposed atop the split hull of the hopper barge 108. The sluiceway device 100 may be modular, i.e., installed in multiple segments along the length of the hopper barge 108, or may be provide as a single, unitary installation that is lowered into the hopper barge 108 by crane during an installation procedure, as desired. Further, the sluiceway device 100 may be fabricated within the barge 108 as a single, unitary, and one-piece sluiceway device 100 and hopper barge 108 assembly according to other embodiments of the present disclosure.

The elongate main body 102 of the sluiceway device 100 may also have an upper major surface 110 for receiving the dredging material 109 placed in the hopper barge 108. In operation, the upper major surface 110 of the sluiceway device 100 is used to selectively hold the dredging material 109 above the split hull until the sluiceway device 100 is operated to remove the dredging material 109, as will be described further herein.

With reference to FIGS. 2-5 and 7, the elongate main body 102 may define a discharge channel 112. The discharge channel 112 may be configured for receiving dredging material 109 and water to be pumped from the hopper barge 108. As with the elongate main body 102 itself, the discharge channel 112 may be oriented along the length of the hopper barge 108 when the elongate main body 102 is disposed atop the split hull of the hopper barge 108. The discharge channel 112 may have a length equal to a length of the hull of the hopper barge 108, for example. Other suitable lengths for the elongate main body 102 and the discharge channel 112 may also be selected, as desired.

With reference to FIG. 1 and FIG. 6, the elongate main body 102 of the sluiceway device may have a plurality of openings 104. As shown in FIGS. 1 and 6, the openings 104 may be spaced apart and disposed evenly across the upper major surface 110 of the elongate main body 102. Though a plurality of openings 104 are shown evenly spaced on the upper major surface 110 of the elongate main body 102, it should be appreciated that one skilled in the art may select any suitable number of openings 104. Further, any configuration of the openings 104 along the elongate main body 102 is contemplated by this present disclosure.

The discharge pump 106, shown in FIGS. 1-2 and 6-7, may be in communication with the discharge channel 112. The discharge pump 106 may be provided separately and connected to the hopper barge 108. The discharge pump 106 may also be connected to the elongate main body 102 of the sluiceway device 100 so that the entire assembly may be lowered or installed into the hopper barge 108 as a single unit, as desired. The discharge pump 106 may be configured to pump the dredging material 109 from the discharge channel 112 to a disposal area outside of the hopper barge 108, for example, a beach where it is desired to deposit the dredging material.

Advantageously, the elongate main body 102 may be removably secured to the bottom of the split hull of the hopper barge 108 with suitable mechanical fasteners 128, such as rails, brackets, and bolts, as non-limiting examples. This allows the sluiceway device 100 to be removed when not in use. One of ordinary skill in the art may select other suitable mechanical fasteners for securing the elongate main body 102 of the sluiceway device 100 within the hopper barge 108, as desired.

In certain embodiments of the present disclosure, the openings 104 may be sealed with doors 114 as shown in FIGS. 2-5. However, other openings 104 for the sluiceway device 100 are contemplated and may also be selected by a skilled artisan within the scope of the present disclosure.

Each of the doors 114, in operation, may be configured to be selectively opened. For example, the openings 104 may be operated in sequence from one end of the elongate main body 102 to another end of the elongate main body 102. This sequential operation of the openings 104 permits the dredging material 109 to fall into the discharge channel 112 in an orderly and predetermined manner further detailed hereinbelow.

As shown in FIGS. 2-5, each of the doors 114 may be attached to the elongate main body 102 with a hinge 115. In a particular embodiment, the hinged doors 114 may be configured to be opened downwardly. The hinged doors 114 may be configured to be opened by at least one actuator 116, such as a hydraulic cylinder. However, other actuators 116 for the sluiceway device 100 including electric and pneumatic actuators 116 are contemplated and may also be selected by a skilled artisan within the scope of the present disclosure.

In particular, each of the hinged doors 114 may be connected to an actuating arm 117 of the at least one actuator 116. The actuating arm 117 may be pivotally attached to the hinged door 114 so that, when the actuating arm 117 is moved downwardly by the actuator 116, the hinged door 114 is likewise opened. This allows the dredging material above the hinged door 114 to fall into the discharge channel 112, for subsequent transport by the discharge pump 106 away from the hopper barge 108, as described further hereinbelow.

Figure 2:
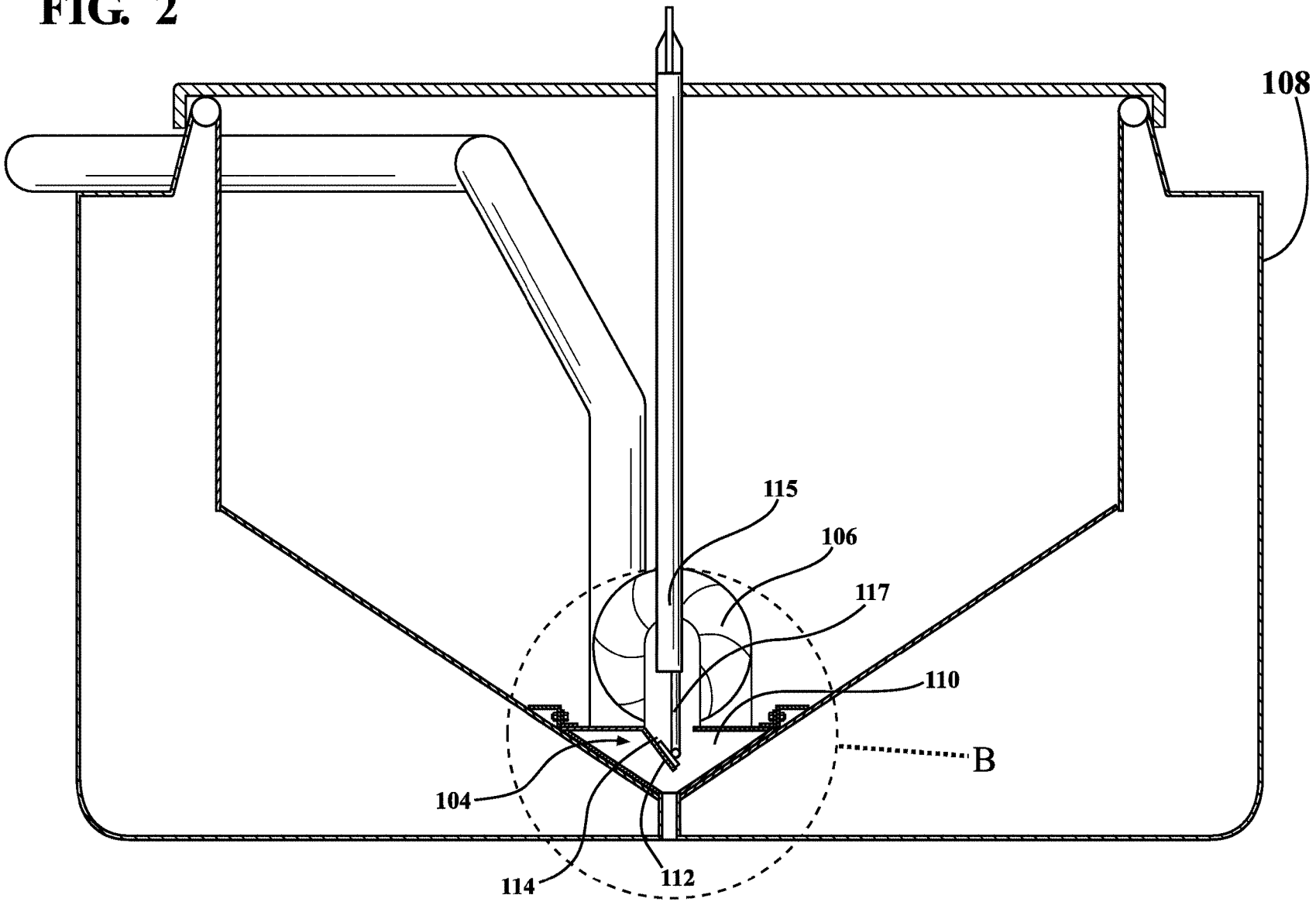
FIG. 2 is a cross-sectional, front elevational view of the hopper barge taken along the section line A-A in FIG. 1, and depicting the sluiceway device according to one embodiment of the disclosure.
Figure 3:
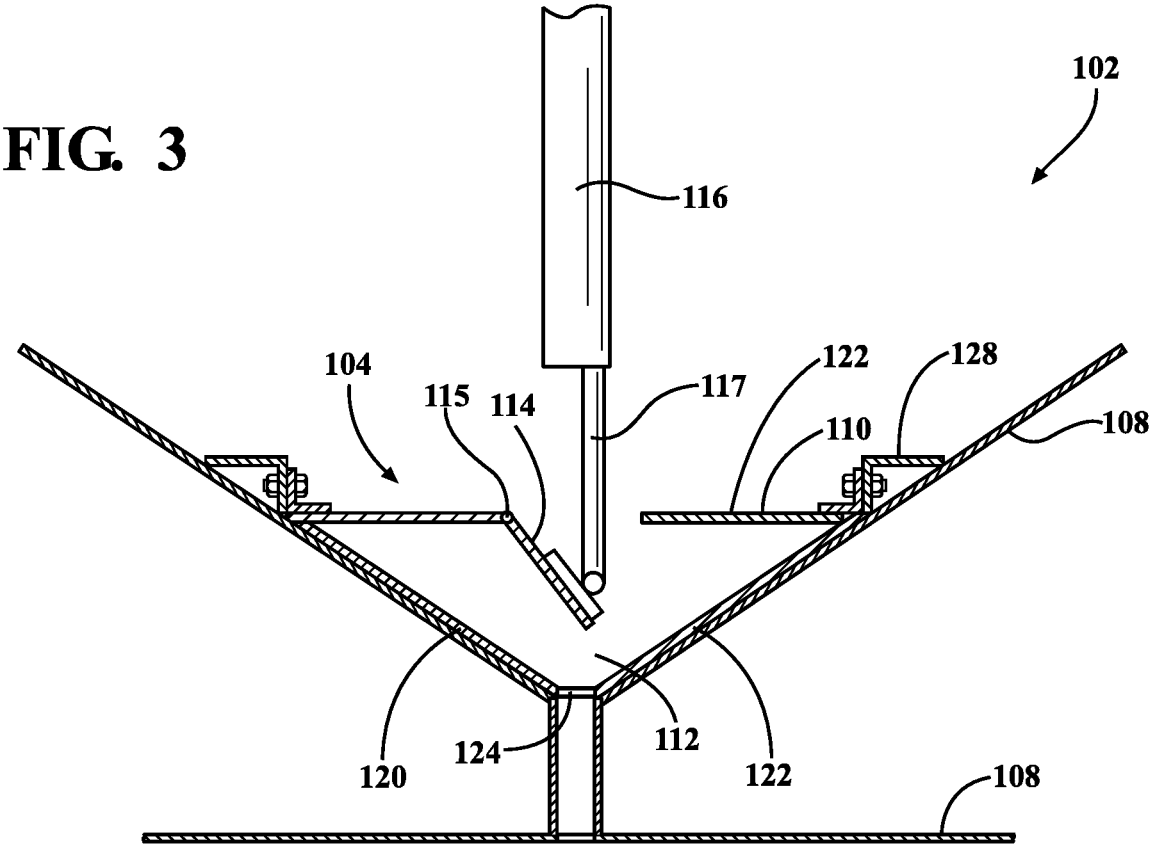
FIG. 3 is an enlarged, cross-sectional, front elevational view of the sluiceway device according to one embodiment of the disclosure and taken at call-out B in FIG. 2.

Various configurations of the discharge channel 112 are envisioned, and all are deemed to be within the scope of the present disclosure. As one non-limiting example, as shown in FIGS. 2-3, the elongate main body 102 may have a trapezoidal shape in cross-section. In particular, the trapezoidal shape may be configured to conform to an inner surface of the split hull of the hopper barge 108.

In this example, and as depicted in FIG. 3, the elongate main body 102 may have a pair of angled walls 120, which are each configured to abut major surfaces of the hull of the hopper barge 108 on opposing sides of the split. The angled walls 120 may be connected by a top plate 122 that defines the upper major surface 110 of the elongate main body 102. The openings 104 of the elongate main body 102 are formed through the top plate 122. The upper major surface 110 may be configured to receive and support the dredging material 109 when disposed in the hopper barge 108.

The angled walls 120 may also be connected by a bottom plate 124. The angled walls 120, the top plate 122, and the bottom plate 124 together provide the trapezoidal shape in cross-section. The hinged doors 114 that selectively seal the openings 104 are disposed on the top plate 122 of the elongate main body 102 in this particular embodiment.

Figure 4:
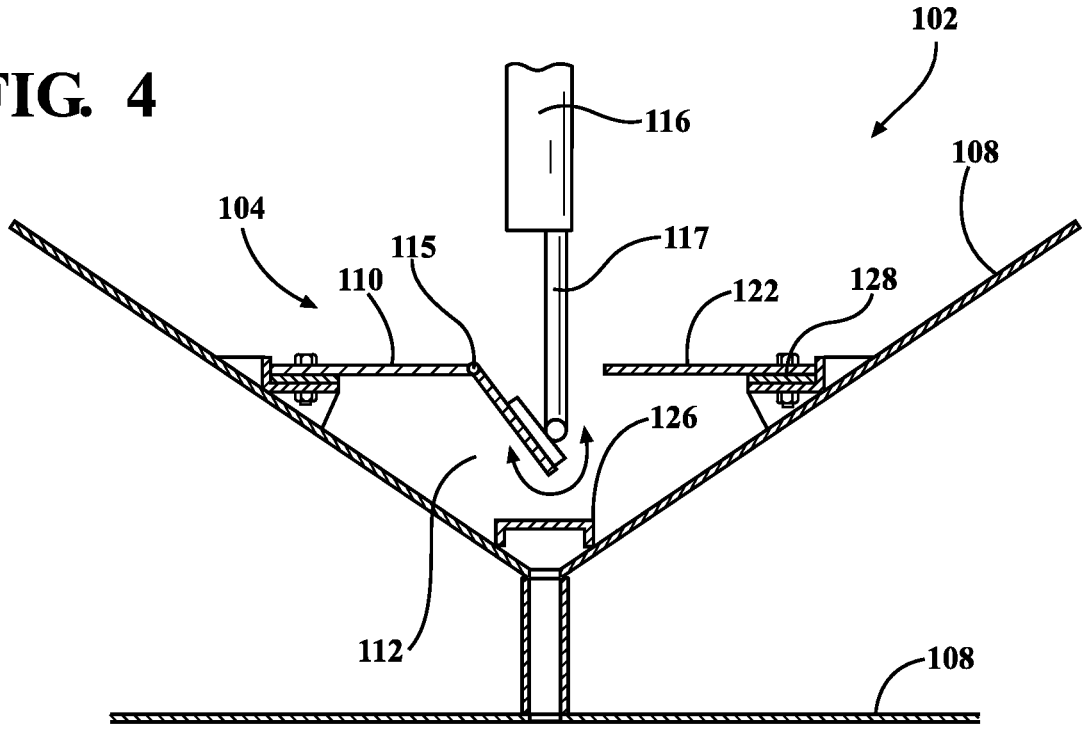
FIG. 4 is an enlarged, cross-sectional, front elevational view of the sluiceway device according to another embodiment of the disclosure and taken at call-out B in FIG. 2.

In another example, shown in FIG. 4, the elongate main body 102 may be defined by only the top plate 122, which in turn defines the upper major surface 110. In this embodiment, the top plate 122 is configured to rest atop an inner surface of the split hull of the hopper barge 108 without the angled walls 120. The elongate main body 102 may also include a bottom cap 126 in this case, which is spaced apart from and not connected with the top plate 122. The bottom cap 126 may be configured to be placed directly above the split hull of the hopper barge and is disposed adjacent the split.

In this example, the upper major surface 110 may be configured to receive and support the dredging material 109 when disposed in the hopper barge 108. The top plate 122 may be secured to the interior surface of the hull on opposing sides with connecting rails, brackets, and bolts 128, as non-limiting examples. One of ordinary skill in the art may select other suitable mechanical fasteners 128 for securing the top plate 122 to the hull of the hopper barge 108, as desired.

With continued reference to FIG. 4, it should be appreciated that the hinged doors 114 seal the openings 104 until the hinged doors 114 are selectively opened, as described hereinabove. The bottom cap 126 militates against the dredging material coming into direct contact with the split in the hull where the hinged door 114 is opened. Advantageously, the sluiceway device 100 shown in FIG. 4 may be particularly useful with a retrofitting of the split hull of the hopper barge 108 by militating against the dredging materials 109 contacting the split of the hull of the barge 108. Furthermore, the bottom cap 126 may hold the two sides of the hull of the hopper barge 108 together, thus militating against the dredging material 109 from falling out of the hopper barge 108 in an unintended manner.

Figure 5:
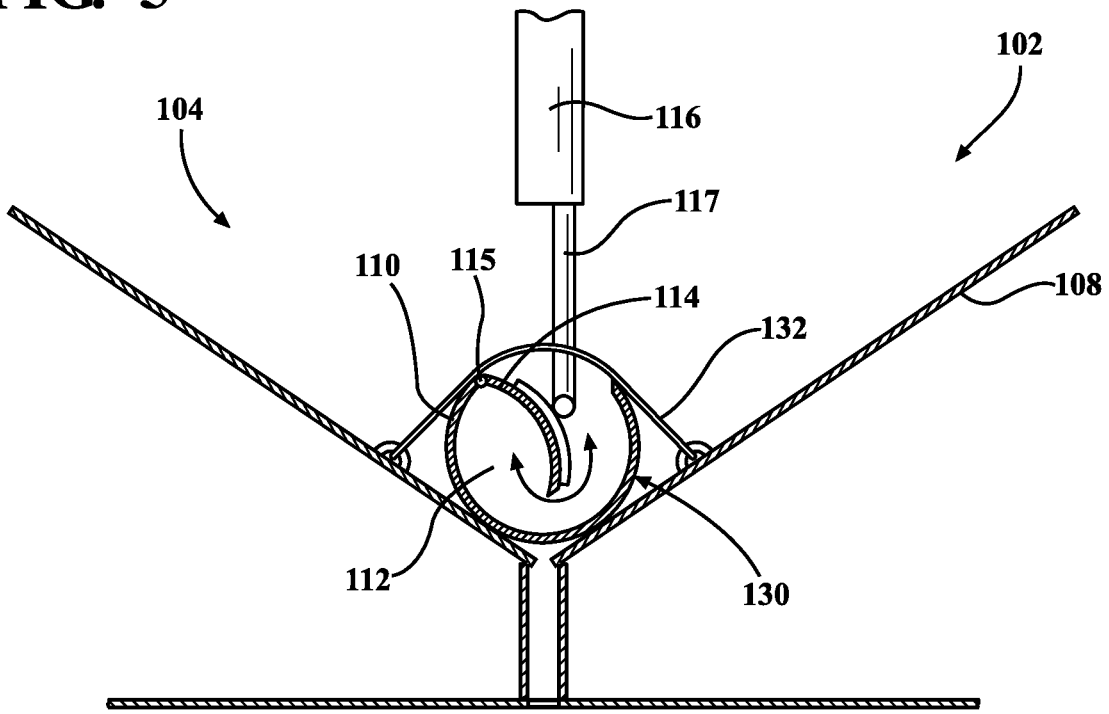
FIG. 5 is an enlarged, cross-sectional, front elevational view of the sluiceway device according to a further embodiment of the disclosure and taken at call-out B in FIG. 2.
Figure 7:
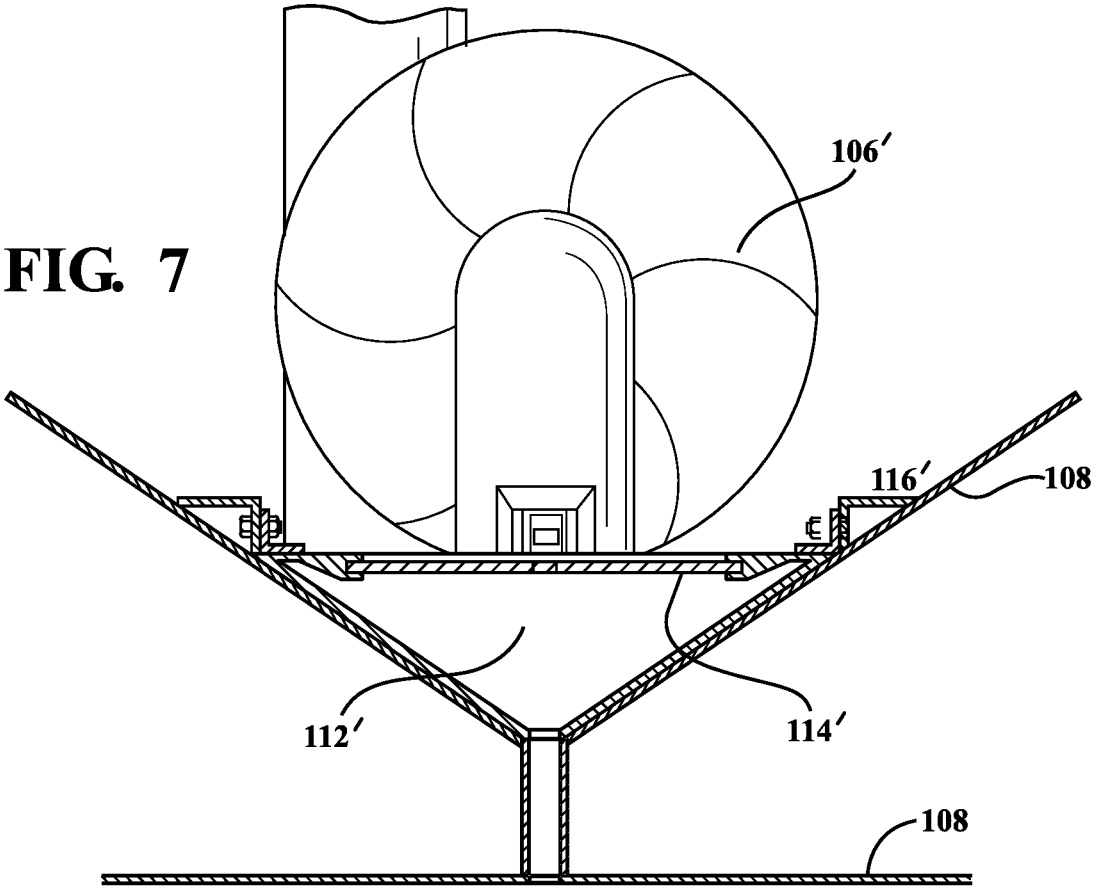
FIG. 7 is an enlarged, cross-sectional, front elevational view of the sluiceway device taken at section line C-C in FIG. 6.

In a further example, shown in FIG. 5, the elongate main body 102 may be defined by a pipe 130. The pipe 130 is oriented along the length of the hopper barge 108 and disposed atop the split in the hull. The pipe 130 may have a substantially circular shape in cross-section, as a non-limiting example. Other suitable cross-sectional shapes for the pipe 130 may also be employed, as desired.

In this example, a top portion of the pipe 130 defines the upper major surface 110 of the sluiceway device 100. The top portion 130 may therefore be configured to receive and support the dredging material 109 when disposed in the hopper barge 108.

With continued reference to FIG. 5, the pipe 130 may be secured to the inner surface of the hull on opposing sides with the mechanical fasteners 128. The mechanical fasteners 128 in this embodiment may include a fastening strap 132, as a non-limiting example. The fastening strap 132 may have a first end that is affixed to a first side wall of the split hull of the hopper barge 108, and a second end that is be affixed to a second side wall of the split hull of the hopper barge 108.

Advantageously, this embodiment may utilize less space inside the hull of the hopper barge 108 in comparison to other embodiments contemplated by this disclosure. As such, this embodiment may then hold more dredging material 109 than a substantially similar sized hopper barge 108 fitted with a different embodiment of the sluiceway device 100.

In FIGS. 6-9, the sluiceway device 100' according to another embodiment of the disclosure is shown. Like or related structure to that shown in FIGS. 1-5 is identified in FIGS. 6-9 with a same reference number and a prime (') symbol for purpose of clarity.

As shown in FIGS. 6-9, the discharge channel 112' may be provided with a plurality of semi-circular hatch openings 104'. The hatch openings 104' may be selectively sealed with a rotating door 114' over at least one semi-circular opening 104', instead of using the hinged doors 114' to selectively seal the openings 104'. The revolving doors 114' may permit for a selective opening by the at least one hatch actuator 116' or by other means to permit the dredging material to fall into the discharge channel 112', within the scope of the disclosure.

In a particular example, as shown in FIGS. 7-10, the actuator 116' may be in the form of a motor 134'. The motor 134' is configured for rotating a gear 136' that is connected by a chain 138' to the revolving door 114'. Upon rotation of the motor 134', the revolving door 114' is caused to rotate to either an opened position or a closed position. One of ordinary skill in the art may also select other means for opening and closing the revolving doors 114', as desired.

In a most particular example, the hatch actuator 116' includes a hydraulic motor 134' with the gear 136' and the chain 138' located on top of the modular section. The chain 138' may be attached to gear pins 140' at the top of the hatch actuator 116' and will open and/or close the semi-circular opening 104' by rotating the revolving door 114'. These components may be completely encased by a metal casing 142' for protection.

Figure 10:
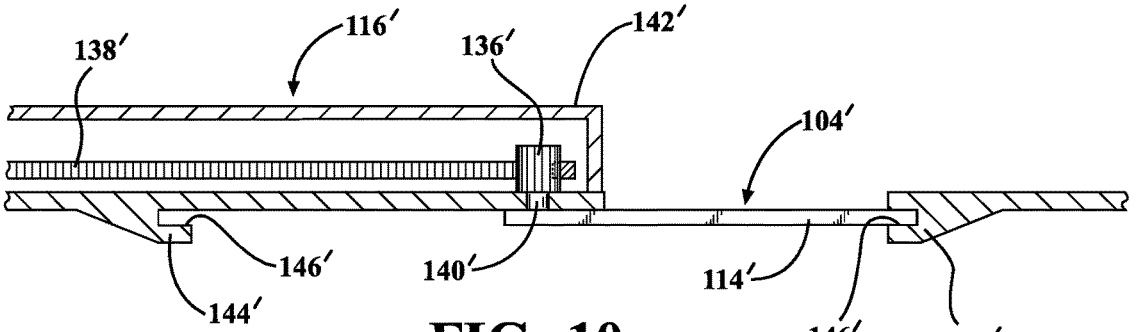
FIG. 10 is an enlarged, fragmentary, cross-sectional, side elevational view of the hatch opening device of the sluiceway device taken at call-out F in FIG. 9.

As shown in FIG. 10, the revolving doors 114' may be semicircular plates. Each of the plates forming the revolving door 114' may have a curved edge and a straight edge. The revolving doors 114' are connected to the hatch actuator 116' via the gear pins 140'. The gear pins 140' are connected with the gears 136' and disposed through the upper major surface 110'. The gear pins 140' also are connected to the revolving doors 114' adjacent to the center of the mostly straight edge of the semi-circular shape as shown in FIG. 10. In operation, as the gear pins 140' are rotated by the hatch actuator 116' the revolving doors 114' are likewise caused to rotate about their respective gear pins 140'.

As further depicted in FIG. 10, the revolving doors 114' may be disposed below the openings 104' and the upper major surface 110'. On a lower face disposed opposite the upper major surface 110' and adjacent to either side of one opening 104', there may be an annular lip 144'. The lip 144' defines a guiding channel 146'. The lip 144' extends from the lower face to an area disposed just below the curved edge of the revolving door 114'. It should be appreciated that the lip 144' entirely envelopes the curved edges of the respective revolving doors 114' such that whether the revolving door 114' is in the open position or the closed position, the revolving door 114' remains in the guiding channel 146' as defined by the lips 144'.

Advantageously, the lip 144' provides support to the revolving doors 114'. In particular, the lip 144' may militate against an undesirable bending, sagging, or breaking of the revolving doors 114' due to a weight of the dredging material 109' where the sluiceway device 100' is in operation. Other suitable means including bracing for further supporting the revolving doors 114' may also be employed.

The present disclosure further includes the method 200 for operating the sluice way device 100, 100' for the barge 108, 108', as shown in FIGS. 11-14, and also detailed hereinbelow.

The method 200 may have a first step 202 of providing the hopper barge 108, 108'. The hopper barge 108, 108' may be a split hull type. However, one skilled in the art may select the hopper barge 108, 108' with different hull types, including non-split designs, as desired.

A second step 204 in the method 200 may include providing the sluiceway device 100, 100' with the at least one opening 104, 104'. As described hereinabove, the sluiceway device 100, 100' includes the elongate main body 102, 102' that defines the discharge channel 112, 112'. The elongate main body 112, 112' has the upper major surface 110, 110'. There are the plurality of openings 104, 104' spaced apart and disposed along the length of the upper major surface 110, 110' These openings 104, 104' may be selectively sealed with the hinged doors 114, as shown in FIGS. 2-5, or the revolving doors 114', as shown in FIGS. 7-10.

In one embodiment, the sluiceway device 100, 100' may be provided separately from the hopper barge 108, 108'. The sluiceway device 100, 100' may then be installed into the hopper barge 108, 108'. The sluiceway device 100, 100' may be installed in a single piece. Where the sluiceway device 100, 100' is a single piece, the sluiceway device 100, 100' may be lowered into the hull of the hopper barge 108, 108' using a crane, as a non-limiting example. The sluiceway device 100, 100' may then be secured to the hull of the hopper barge 108, 108' using fasteners.

In other embodiments, the sluiceway device 100, 100' may also be installed in multiple, individual segments along the hull of the hopper barge 108, 108'. The individual segments are then connected, for example, by welding or mechanical fasteners, in order to form the completed sluiceway device 100, 100'.

In yet another embodiment, the sluiceway device 100, 100' may be preinstalled with the hopper barge 108, 108'. In this embodiment, the sluiceway device 100, 100' is fabricated within the hopper barge 108, 108' during manufacture of the hopper barge 108, 108'. In this manner, the sluiceway device 100, 100' may be provided as an integral part of the hopper barge 108, 108' assembly.

The hopper barge 108, 108' may also have the discharge pump 106, 106'. The discharge pump 106, 106' may be previously installed on the hopper barge 108, 108' in cases where a hopper barge 108, 108' is being retrofitted with the sluiceway device 100, 100'. Alternatively, the discharge pump 106, 106' may be installed as a separate component together with the installation of the sluiceway device 100, 100', as either a single piece or in the multiple individual segments as described hereinabove. For example, the discharge pump 106, 106' may be attached to the sluiceway device 100, 100', or the discharge pump may be installed concurrently into the hull of the hopper barge 108, 108' while the sluiceway device 100, 100' is installed.

The method 200 then includes a third step 206 of filling the hopper barge 108, 108' with dredging material 109, 109'. In this step 206, the sluiceway device 100, 100' has been installed. The at least one opening 104, 104' remains sealed by the door 114', 114' during the filling of the hopper barge 108, 108'.

Figure 11:
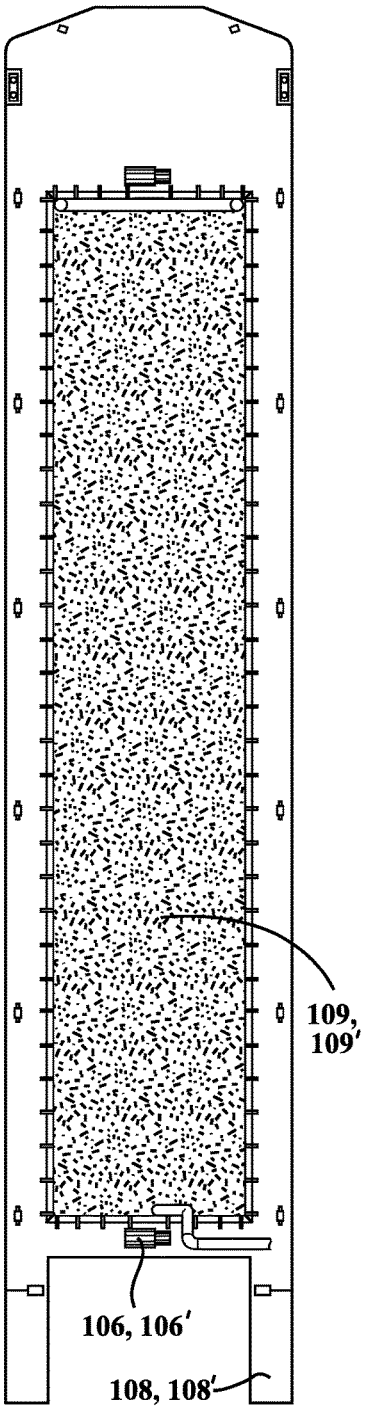
FIG. 11 is a top plan view of the hopper barge depicted in FIG. 6, the barge shown filled with dredging material.
Figure 12:
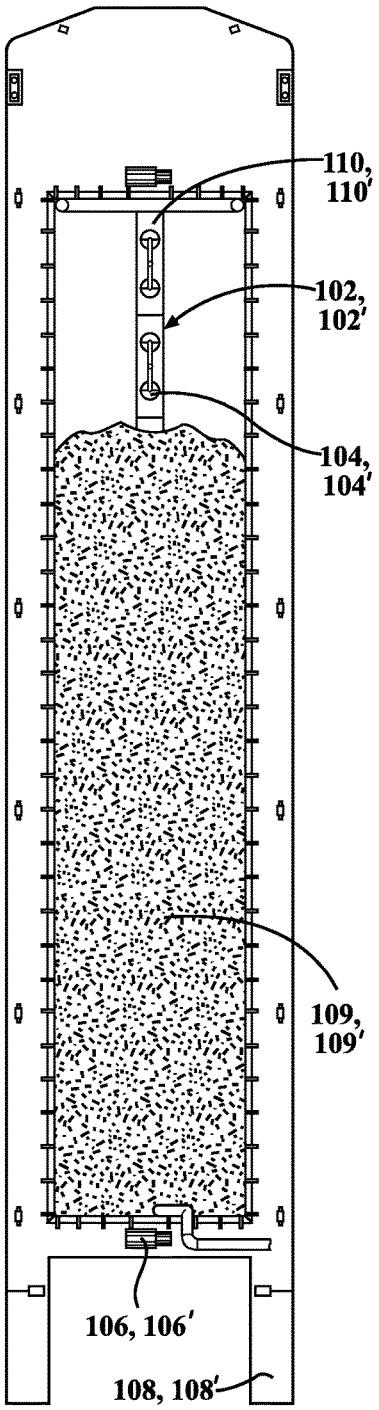
FIG. 12 is a top plan view of the hopper barge depicted in FIG. 10, the barge shown in a process of emptying the dredging material.
Figure 13:
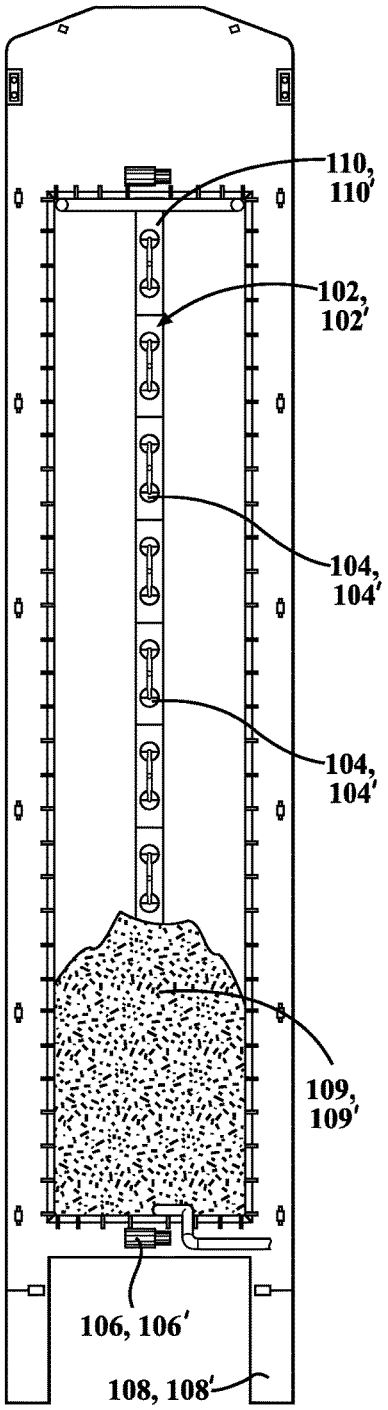
FIG. 13 is a top plan view of the hopper barge depicted in FIGS. 10 and 11, the barge further shown in the process of emptying the dredging material.
Figure 14:
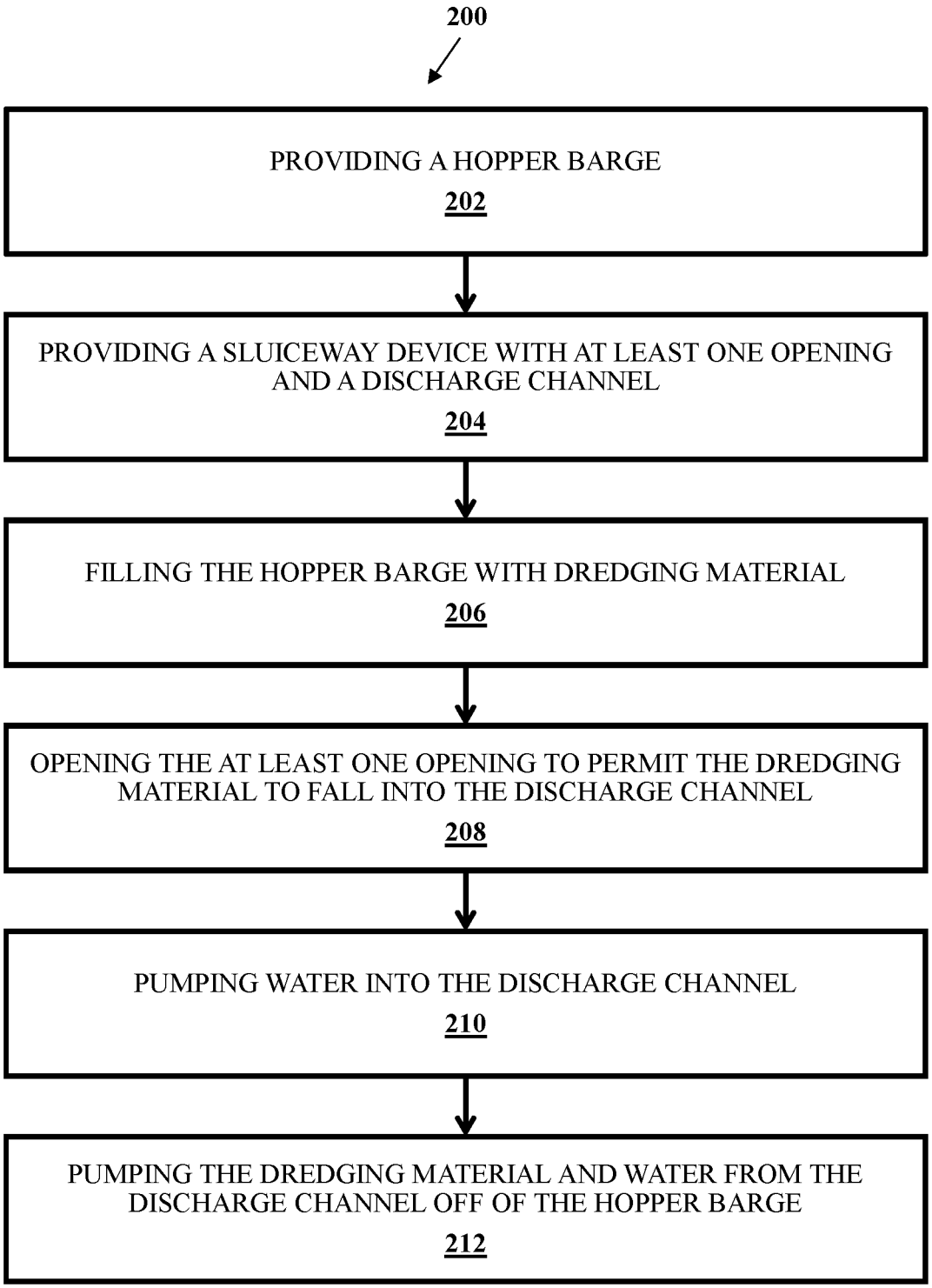
FIG. 14 is a flowchart that illustrates a method of using a sluiceway device for a barge as shown in FIGS. 1-13, according to various embodiments of the disclosure.

The hopper barge 108, 108' may be filled using conventional dredging methods. The dredging material 109, 109' is supported by the upper major surface 110, 110' of the elongate main body 102, 102' of the sluiceway device 100, 100'. The hopper barge 108, 108' may then be transported to the disposal location for the dredging material 109, 109'. The filled hopper barge 108, 108' is depicted in FIG. 11.

A fourth step 208 of the method 200 then includes unsealing the at least one opening 104, 104' to permit the dredging material 109, 109' to fall into the discharge channel 112, 112'. The doors 114, 114' of the openings 104, 104' may be opened by the at least one actuator 116, 116', for example, as described hereinabove with respect to FIGS. 1-10.

The method 200 may then include a fifth step 210 of pumping water into the discharge channel 112, 112'. Once the dredging material is in the discharge channel 112, 112', additional pumps may be used to direct water into the discharge channel 112, 112'. The additional pumps may be provided with the hopper barge 108 or the additional pumps may be provided with the sluiceway device 100, 100' and installed into the hull of the hopper barge 108, 108'. Advantageously, pumping water into the discharge channel 112, 112' while discharge material 109, 109' is present may allow the dredging material 109, 109' to flow through the discharge channel 112, 112' more efficiently than it could without the water being present.

A sixth step 212 of the method 206 may include a pumping of the dredging material 109, 106' and water from the discharge channel 112, 112' away from the hopper barge 108, 108'. After the water and dredging material 109, 109' are pumped together in the discharge channel 112, 112', the discharge pumps 106, 106' may then be used to pump the dredging material 109, 109' from the hopper barge 108, 108'. The discharge pumps 106, 106' may pump the dredging material 109, 109' onto a beach or any other suitable location for disposal of the dredging material. Advantageously, the discharge pumps 106, 106' allow hopper barges 108, 108' to transport dredging materials 109, 109' to sites that were not previously available due to the limitations of split hull hopper barges 108, 108'.

In a particular embodiment, the elongate main body 102, 102' of the sluiceway device 100, 100' may have at least two openings 104, 104'. The at least two openings include a first opening 104, 104' and a second opening 104, 104'. In this embodiment, the first opening 104, 104' is unsealed first according to the method 200. Once the dredging material 109, 109' at the first opening 104, 104' is disposed in the discharge channel 112, 112', then the second opening 104, 104' is also unsealed in sequence.

More specifically, the first door 114, 114' is opened, water is added to the discharge channel 112, 112' and the discharge material 109, 109' is pumped from the boat. The second door 114, 114' is then opened, water is added to the discharge channel 112, 112' and the dredging materials 109, 109' are pumped from the hopper barge 108, 108'.

It should be appreciated that this ordered unsealing of the at least two openings 104, 104' may be performed with as many openings 104, 104' are present in the sluiceway device 100, 100', and in any suitable order, within the scope of the disclosure.

In a most particular example, as shown in FIGS. 10-13, the sluiceway device 100, 100' has a plurality of openings 104, 104'. The method 200 for employing the sluiceway device 100, 100' then includes repeating the steps of the method 200 for each opening present on the sluiceway device 100, 100'.

In this embodiment, the doors 114, 114' would be opened sequentially. The sequential opening of the doors 114, 114' may include opening the door 114, 114' nearest the end of the hopper barge 108, 108' furthest from the discharge pumps 106, 106'. The doors 114, 114' may then be opened in order moving towards the discharge pumps 106, 106' until all of the doors 114, 114' have been opened and substantially all the dredging material has been emptied from the hopper barge 108, 108'. It should be understood that one skilled in the art may open the plurality of doors 114, 114' in any other order and according to any suitable timing, as desired.

Advantageously, the sluiceway device 100, 100' of the present disclosure is especially useful for converting the hopper barge 108, 108' into a vessel for pumping contents such as the dredging material 109, 109' to a disposal area, such as a beach. The sluiceway device 100, 100' is easily installed in a conventional split-type hopper barge 108, 108'. Thus, the sluiceway device 100, 100' permits retrofitting of hopper barges 108, 108' in a manner that is less complicated an inexpensive relative to earlier-known retrofitting methods in the art.

While certain representative embodiments and details have been shown for purposes of illustrating the invention, it will be apparent to those skilled in the art that various changes may be made without departing from the scope of the disclosure, which is further described in the following appended claims.

What is claimed is:

1. A sluiceway device for a hopper barge, comprising:

an elongate main body configured to be disposed atop an inner surface of a hull of the hopper barge and configured to receive dredging material placed in the hopper barge, the main body having a plurality of openings formed therein, the elongate main body further including a plurality of doors that are disposed adjacent the openings and configured to selectively seal and unseal the openings, a volume disposed between the doors and the inner surface of the hull defining a discharge channel;

at least one mechanical fastener attached to the elongate main body and configured to removably secure the elongate main body to the inner surface of the hull; and a discharge pump in communication with the discharge channel and configured to pump the dredging material from the discharge channel to a disposal area outside of the hopper barge.

2. The sluiceway device of claim 1, wherein the discharge channel has a length that is substantially the same as a length of the hull of the hopper barge.

3. The sluiceway device of claim 1, wherein the elongate main body has an upper major surface through which the openings are formed.

4. The sluiceway device of claim 3, wherein the openings are evenly spaced apart along a length of the upper major surface of the elongate main body.

5. The sluiceway device of claim 1, wherein each of the doors is coupled to an actuator.

6. The sluiceway device of claim 5, wherein the actuator is one of a hydraulic actuator, an electric actuator, and a pneumatic actuator.

7. The sluiceway device of claim 1, wherein the doors are hinged doors.

8. The sluiceway device of claim 7, wherein each of the hinged doors are configured to be selectively opened downwardly toward the discharge channel.

9. A sluiceway device for a hopper barge, comprising:

an elongate main body defining a discharge channel, the elongate main body configured to be disposed atop an inner surface of a hull of the hopper barge and configured to receive dredging material placed in the hopper barge, the main body having a plurality of openings formed therein;

a plurality of doors disposed adjacent the openings and configured to selectively seal and unseal the openings; and a discharge pump in communication with the discharge channel and configured to pump the dredging material from the discharge channel to a disposal area outside of the hopper barge, wherein the elongate main body has a trapezoidal shape in cross-section, the trapezoidal shape configured to conform to the inner surface of the hull of the hopper barge.

10. A sluiceway device for a hopper barge, comprising:

an elongate main body defining a discharge channel, the elongate main body configured to be disposed atop an inner surface of a hull of the hopper barge and configured to receive dredging material placed in the hopper barge, the main body having a plurality of openings formed therein;

a plurality of doors disposed adjacent the openings and configured to selectively seal and unseal the openings; and a discharge pump in communication with the discharge channel and configured to pump the dredging material from the discharge channel to a disposal area outside of the hopper barge, wherein the elongate main body includes a top plate configured to rest atop the inner surface of the hull of the hopper barge, and a bottom cap configured to be placed below the top plate.

11. The sluiceway device of claim 7, wherein the elongate main body is a pipe.

12. The sluiceway device of claim 1, wherein the doors are rotating doors.

13. The sluiceway device of claim 12, wherein the rotating doors are semi-circular plates.

14. The sluiceway device of claim 12, wherein the revolving door is attached to a chain, at least one gear, and a motor that rotate the door.

15. The sluiceway device of claim 12, wherein the rotating doors are enveloped in an annular ring.

16. A hopper barge assembly, comprising:

a hopper barge having a hull with an inner surface;

an elongate main body disposed atop an inner surface of a hull of the hopper barge and configured to receive dredging material placed in the hopper barge, the main body having a plurality of openings formed therein, the elongate main body further including a plurality of doors that are disposed adjacent the openings and configured to selectively seal and unseal the openings, a volume disposed between the doors and the inner surface of the hull defining a discharge channel;

at least one mechanical fastener attached to the elongate main body and configured to removably secure the elongate main body to the inner surface of the hull; and a discharge pump in communication with the discharge channel and configured to pump the dredging material from the discharge channel to a disposal area outside of the hopper barge.

17. A method for transporting dredging material, the method comprising the steps of:

providing a hopper barge assembly including a hopper barge and a sluiceway device, the sluiceway device having an elongate main body disposed atop an inner surface of a hull of the hopper barge and configured to receive dredging material placed in the hopper barge, the main body having a plurality of openings formed therein, the elongate main body further including a plurality of doors that are disposed adjacent the openings and configured to selectively seal and unseal the openings, a volume disposed between the doors and the inner surface of the hull defining a discharge channel, at least one mechanical fastener attached to the elongate main body and removably securing the elongate main body to the inner surface of the hull, and a discharge pump in communication with the discharge channel and configured to pump the dredging material from the discharge channel to a disposal area outside of the hopper barge;

filling the hopper barge with dredging material;

opening the at least one of the doors to permit the dredging material to fall into the discharge channel;

pumping water into the discharge channel; and pumping the dredging material and water from the discharge channel from the hopper barge.

18. A method for transporting dredging material, the method comprising the steps of:

providing a hopper barge assembly including a hopper barge and a sluiceway device, the sluiceway device having been installed onto a hull of the hopper barge, the sluiceway device having an elongate main body defining a discharge channel, disposed atop an inner surface of the hull of the hopper barge and configured to receive dredging material placed in the hopper barge, the main body having a plurality of openings formed therein, a plurality of doors disposed adjacent the openings and configured to selectively seal and unseal the openings, and a discharge pump in communication with the discharge channel and configured to pump the dredging material from the discharge channel to a disposal area outside of the hopper barge;

filling the hopper barge with the dredging material;

opening at least two of the doors to permit the dredging material to fall into the discharge channel:

pumping water into the discharge channel; and pumping the dredging material and water from the discharge channel from the hopper barge, wherein the step of opening the at least two of the doors further includes opening the doors sequentially.

19. The method for operating the sluiceway device of claim 18, wherein the sequence that the doors are opened is from an end furthest from the discharge pump to an end closest to the discharge pump.

* * * * *